US009613736B1

(12) United States Patent
Chen et al.

(10) Patent No.: US 9,613,736 B1
(45) Date of Patent: Apr. 4, 2017

(54) POSITIVE TEMPERATURE COEFFICIENT CIRCUIT PROTECTION CHIP DEVICE

(71) Applicant: FUZETEC TECHNOLOGY CO. LTD., New Taipei (TW)

(72) Inventors: Jack Jih-Sang Chen, New Taipei (TW); Chang-Hung Jiang, New Taipei (TW)

(73) Assignee: Fuzetec Technology Co., Ltd., New Taipei (TW)

( * ) Notice: Subject to any disclaimer, the term of this patent is extended or adjusted under 35 U.S.C. 154(b) by 37 days.

(21) Appl. No.: 14/870,489

(22) Filed: Sep. 30, 2015

(51) Int. Cl.

| | |
|---|---|
| ***H01C 7/10*** | (2006.01) |
| ***H01C 17/00*** | (2006.01) |
| ***H01C 7/00*** | (2006.01) |
| ***H01C 17/28*** | (2006.01) |

(52) U.S. Cl.
CPC ..... *H01C 17/006* (2013.01); *H01C 7/008* (2013.01); *H01C 17/28* (2013.01)

(58) Field of Classification Search
CPC ..... H01C 17/006; H01C 7/008; H01C 17/28
USPC ..... 338/22 R, 13
See application file for complete search history.

(56) References Cited

U.S. PATENT DOCUMENTS 5,280,263 A * 1/1994 Sugaya ..... H01C 7/027 252/502
7,892,392 B2 * 2/2011 Wang ..... B32B 37/10 156/250
8,368,504 B1 * 2/2013 Chen ..... H01C 7/02 252/511
2004/0227611 A1 * 11/2004 Chu ..... H01C 7/025 337/167
2006/0157891 A1 * 7/2006 Hardy ..... H01C 7/003 264/261
2008/0289751 A1 * 11/2008 Wang ..... B32B 37/10 156/256
2010/0299919 A1 * 12/2010 Chen ..... H01C 7/027 29/846
2011/0241818 A1 * 10/2011 Sha ..... H01C 7/027 338/22 R
2013/0070380 A1 * 3/2013 Wang ..... H01C 7/027 361/93.8

* cited by examiner

*Primary Examiner* — Kyung Lee
(74) *Attorney, Agent, or Firm* — Michael Best & Friedrich LLP

(57) ABSTRACT

A method of making a PTC protection chip device includes: preparing an assembly of a PTC polymer material, a spacer unit, and first and second electrode sheets of a metal-plated copper foil, the PTC polymer material and the spacer unit of the assembly being sandwiched between and cooperating with the first and second electrode sheets to form a stack; subjecting the stack to a hot pressing process, so that the first and second electrode sheets contact and are pressed against the PTC polymer material and the spacer unit and so that the PTC polymer material is bonded to and cooperates with the first and second electrode sheets to form a PTC laminate; and cutting the PTC laminate so as to form the PTC circuit protection chip device.

15 Claims, 6 Drawing Sheets

POSITIVE TEMPERATURE COEFFICIENT CIRCUIT PROTECTION CHIP DEVICE

FIELD

This disclosure relates to a positive temperature coefficient (PTC) circuit protection chip device and a method of making the same, more particularly to a method of making a PTC circuit protection chip device that involves the use of a spacer unit in a hot pressing process.

BACKGROUND

A positive temperature coefficient (PTC) element exhibits a PTC effect that renders the same to be useful as a circuit protecting device, such as a resettable fuse. The PTC element includes a PTC polymer material and first and second electrodes attached to two opposite surfaces of the PTC polymer material.

The PTC polymer material includes a polymer matrix that contains a crystalline region and a non-crystalline region, and a particulate conductive filler dispersed in the non-crystalline region of the polymer matrix and formed into a continuous conductive path for electrical conduction between the first and second electrodes. The PTC effect is a phenomena that when the temperature of the polymer matrix is raised to its melting point, crystals in the crystalline region start melting, which results in generation of a new non-crystalline region. As the new non-crystalline region is increased to an extent to merge into the original non-crystalline region, the conductive path of the particulate conductive filler will become discontinuous and the resistance of the PTC polymer material will be sharply increased, thereby resulting in an electrical disconnection between the first and second electrodes.

FIGS. 1 to 4 illustrate consecutive steps of a conventional method of making a PTC circuit protection chip device. The conventional method includes: preparing a PTC composition containing a polymer material and a conductive filler; compounding the PTC composition under a temperature of about 200° C. and extruding the PTC composition to form PTC pellets 101; hot pressing the PTC pellets 101 in a mold 100 under about 200° C. to form a compounded sheet 11 (see FIGS. 1 and 2); disposing the compounded sheet 11 between two metal foil sheets 12 to form a stack 10 (see FIG. 2); hot pressing the stack 10 under a temperature of about 200° C. (see FIG. 2); cutting the hot-pressed stack 10 into a plurality of chips 13, each of which includes first and second electrodes 131 and a PTC body 132 sandwiched between the first and second electrodes 131 (see FIG. 3); cross-linking the PTC body 132 of each chip 13 by irradiating it using Co_60 gamma ray; and welding first and second terminal leads 14 respectively to the first and second electrodes 131 with a solder material through welding techniques (see FIG. 4). The welding temperature depends on the solder material employed, and is normally about or greater than 260° C. Since the aforesaid welding operation is required to be operated under a temperature of about or greater than 260°C, the high welding temperature unavoidably results in degradation of the PTC body 132 of the chip 13, which, in turn, degrades electrical properties and the PTC effect of the chip 13 and reduces the service life of the chip 13.

SUMMARY

Therefore, an object of the present disclosure is to provide a PTC circuit protection chip device and a method of making the same that can overcome the aforesaid drawback associated with the prior art.

According to one aspect of this disclosure, there is provided a method of making a PTC circuit protection chip device. The method includes: preparing an assembly of a PTC polymer material, a spacer unit, and first and second electrode sheets of a metal-plated copper foil, the PTC polymer material and the spacer unit of the assembly being sandwiched between and cooperating with the first and second electrode sheets to form a stack; subjecting the stack to a hot pressing process, so that the first and second electrode sheets contact and are pressed against the PTC polymer material and the spacer unit and so that the PTC polymer material is bonded to and cooperates with the first and second electrode sheets to form a PTC laminate; and cutting the PTC laminate so as to form the PTC circuit protection chip device.

According to another aspect of this disclosure, there is provided a PTC protection chip device that includes: a FTC body of a PTC polymer material having opposite first and second surfaces and a peripheral end that is disposed between and interconnects the first and second surfaces; a first single piece of a metal-plated copper foil that has a first electrode portion which is hot-pressedly bonded to the first surface of the PTC body, and a first terminal lead portion that extends from the first electrode portion beyond the peripheral end of the PTC body; and a second single piece of a metal-plated copper foil that has a second electrode portion which is hot-pressedly bonded to the second surface of the PTC body, and a second terminal lead portion that extends from the second electrode portion beyond the peripheral end of the PTC body. The first electrode portion has two opposite punched first side-end-faces that are flush with the peripheral end of the PTC body. The first terminal lead portion has two opposite punched first transverse-end-faces, each of which is transverse to and intersects a respective one of the first side-end-faces so as to define a first corner therebetween. The second electrode portion has two opposite punched second side-end-faces that are flush with the peripheral end of the PTC body. The second terminal lead portion has two opposite punched second transverse-end-faces, each of which is transverse to and intersects a respective one of the second side-end-faces so as to define a second corner therebetween.

BRIEF DESCRIPTION OF THE DRAWINGS

In drawing which illustrate an embodiment of the disclosure.

DETAILED DESCRIPTION

Figure 1:
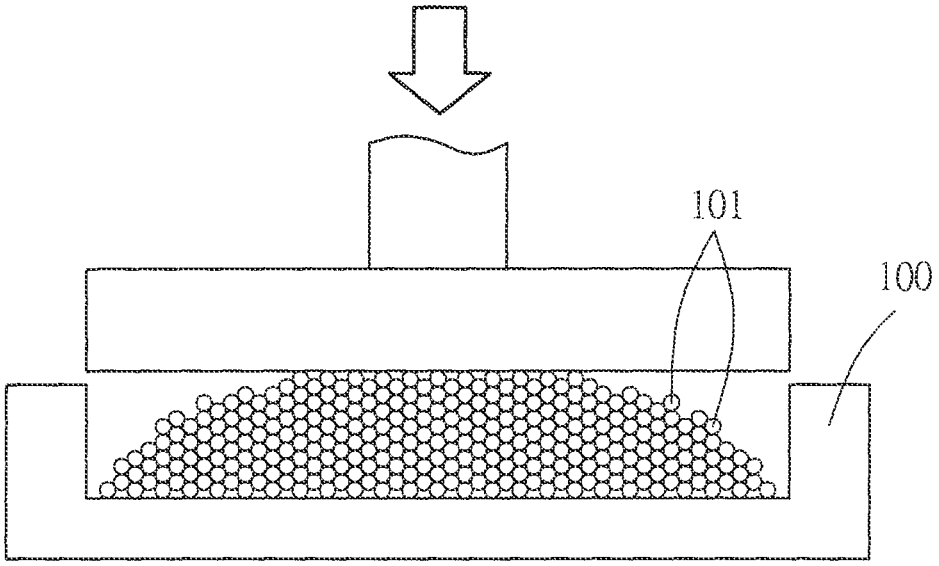
FIG.1 PRIOR ART
FIGS. 1 to 4 are schematic views to illustrate consecutive steps of a conventional method of making a PTC circuit protection chip device.
Figure 4:
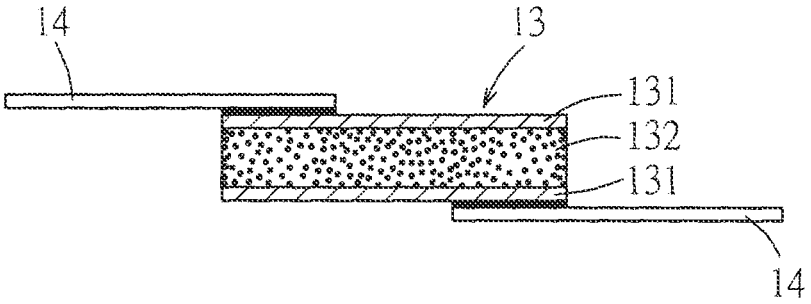
FIG.4 PRIOR ART
Figure 2:
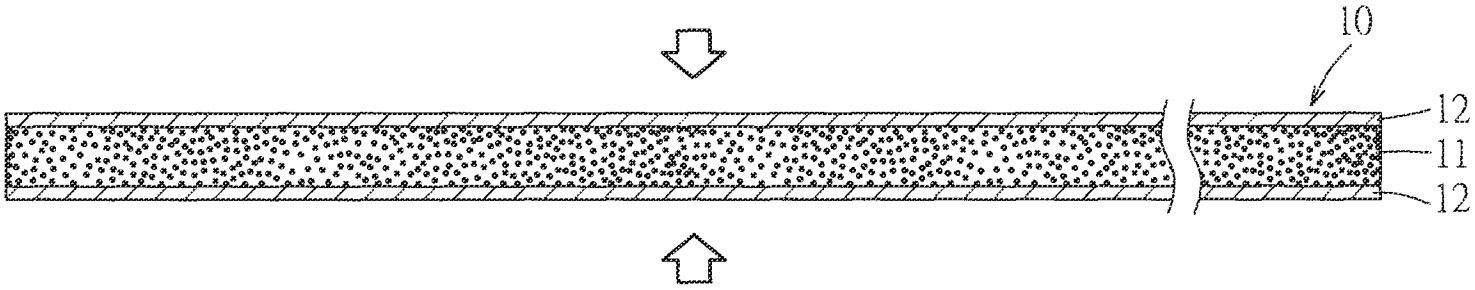
FIG.2 PRIOR ART
Figure 3:
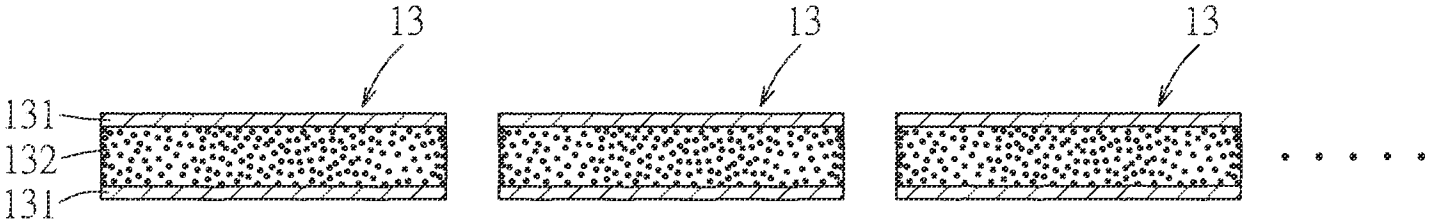
FIG.3 PRIOR ART
Figure 5:
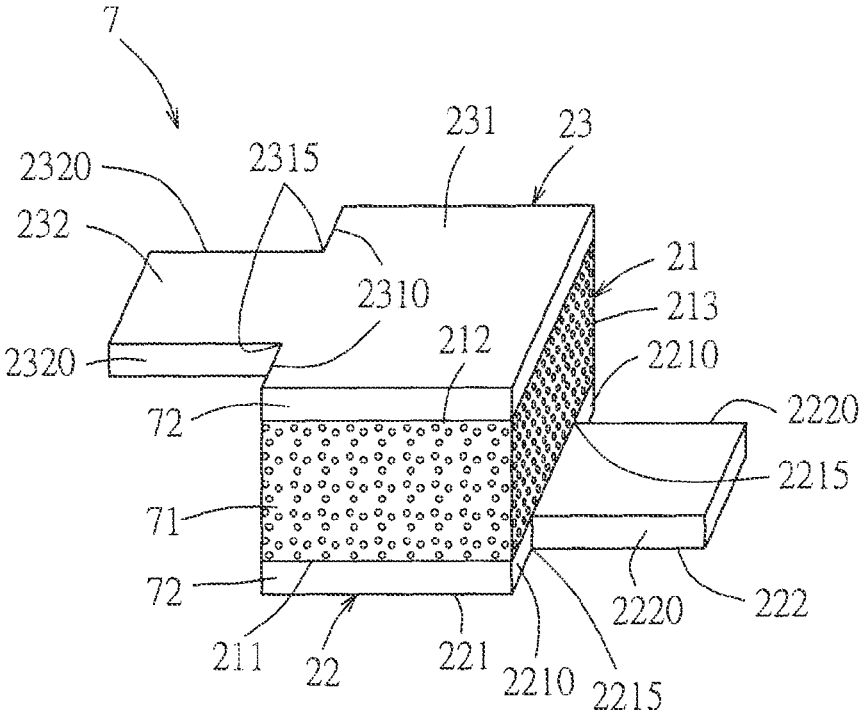
FIG. 5 is a perspective view of the embodiment of a PTC circuit protection chip device according to the present disclosure.
Figure 6:
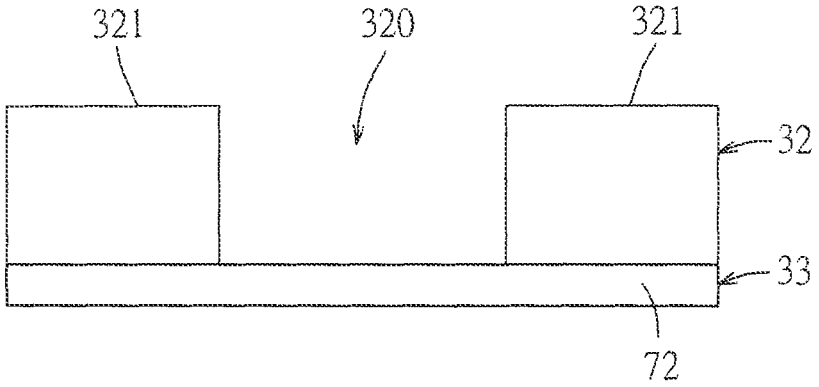
FIGS. 6 to 12 are schematic views to illustrate steps of a method of making the embodiment of the PTC circuit protection chip device according to the present disclosure.
Figure 7:
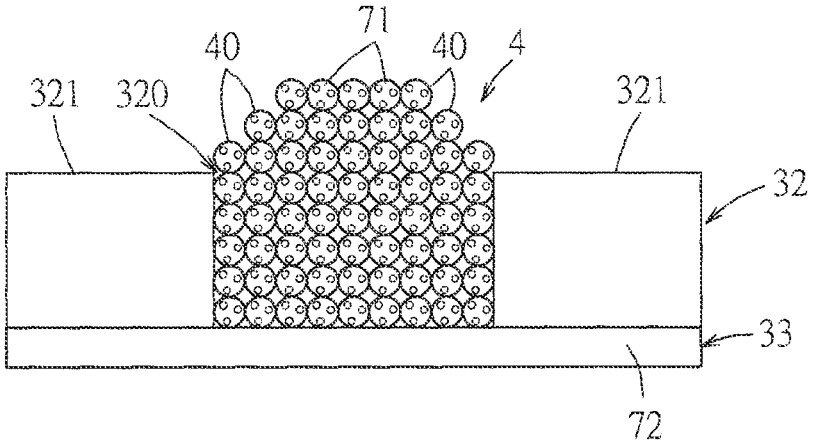
Figure 8:
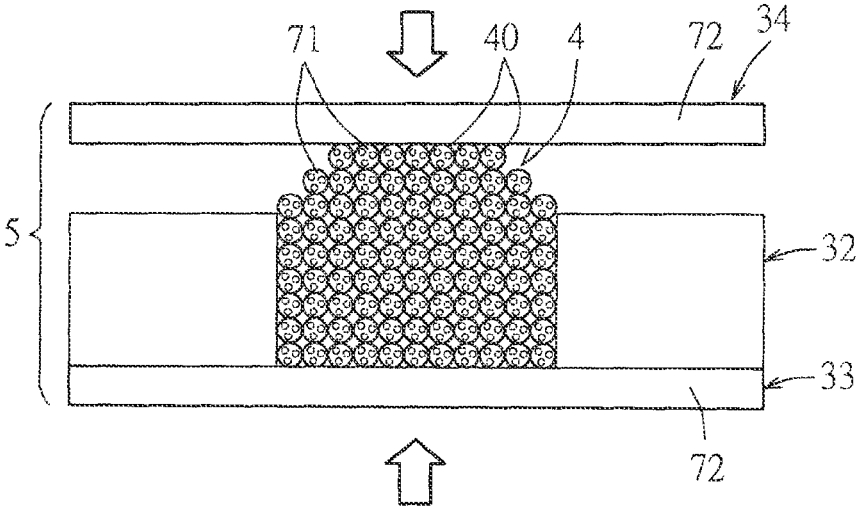
Figure 9:
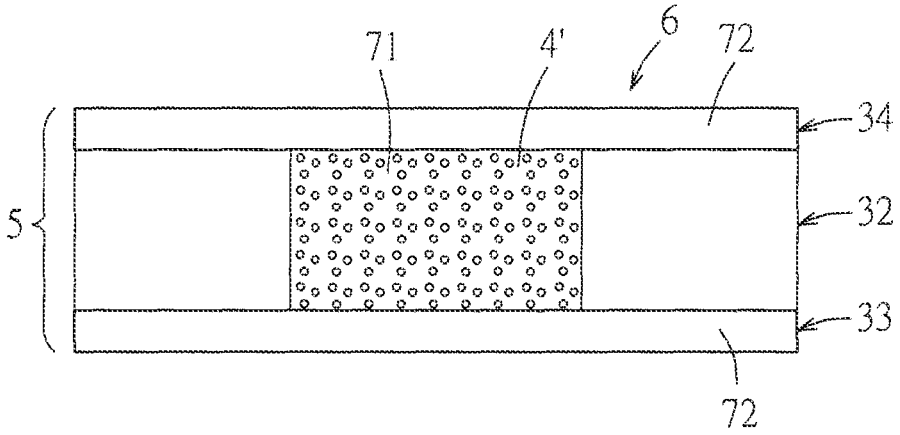
Figure 10:
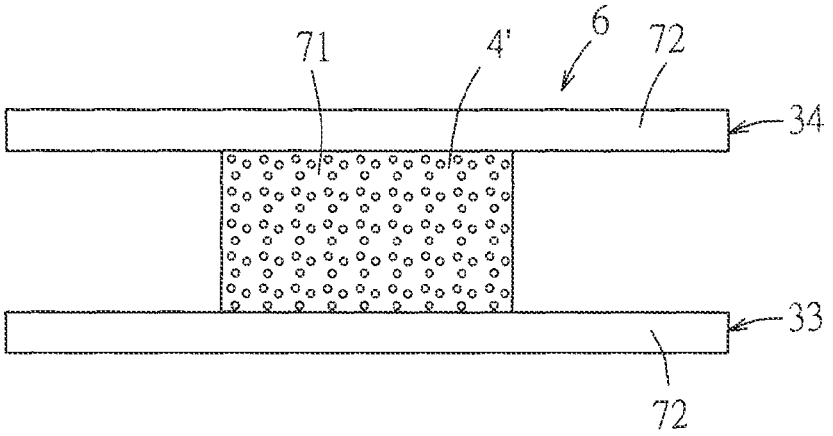
Figure 11:
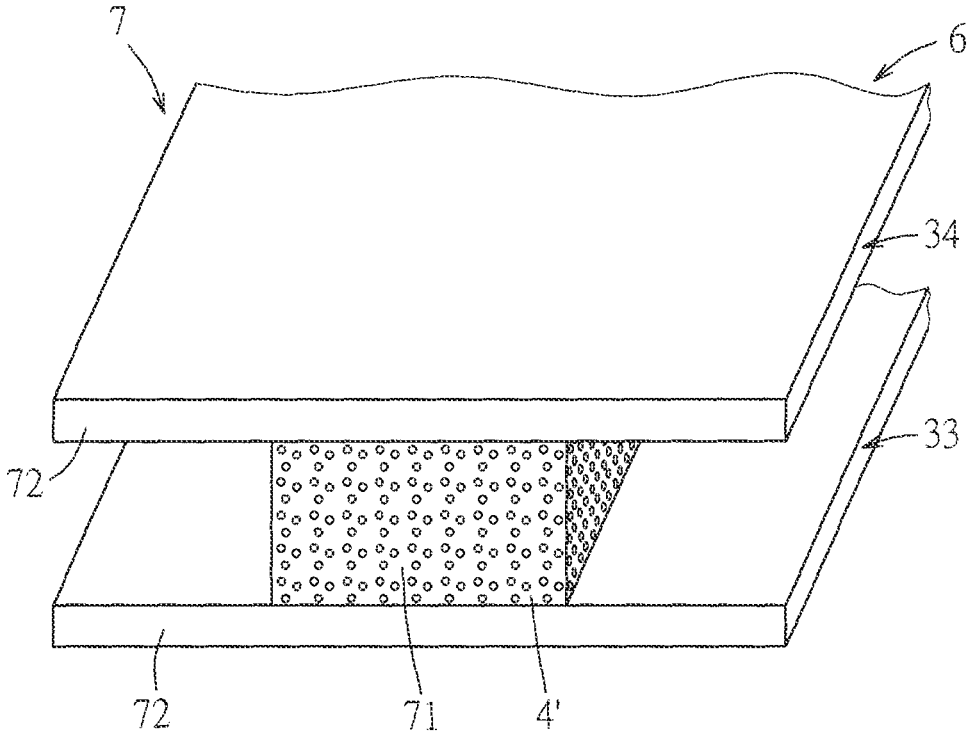
Figure 12:
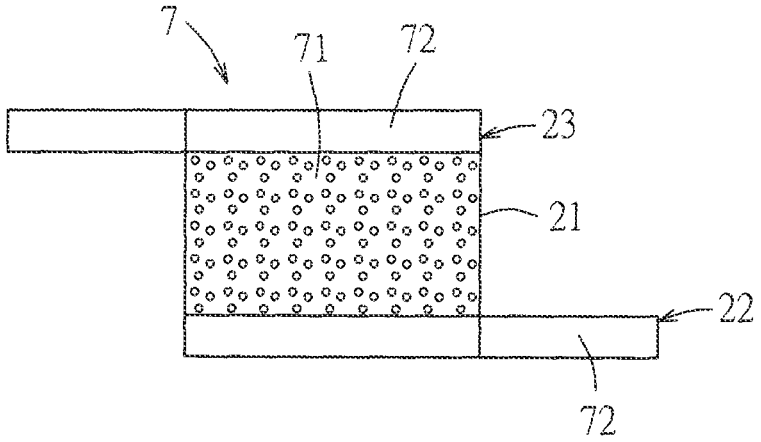

FIG. 5 illustrates the embodiment of a PTC circuit protection chip device 7 according to the present disclosure. In this embodiment, the PTC circuit protection chip device 7 includes: a PTC body 21 of a PTC polymer material 71 having opposite first and second surfaces 211, 212 and a peripheral end 213 that is disposed between and interconnects peripheries of the first and second surfaces 211, 212; a first single piece 22 of a metal-plated copper foil 72 that has a first electrode portion 221 which is hot-pressedly bonded to the first surface 211 of the PTC body 21, and a first terminal lead portion 222 that extends from the first electrode portion 221 beyond the peripheral end 213 of the PTC body 21; and a second single piece 23 of the metal-plated copper foil 72 that has a second electrode portion 231 which is hot-pressedly bonded to the second surface 212 of the PTC body 21, and a second terminal lead portion 232 that extends from the second electrode portion 231 beyond the peripheral end 213 of the PTC body 21. In certain embodiments, the first and second single pieces 22, 23 are formed by punching two metal-plated foil sheets of a sandwiched layered structure (not shown).

In this embodiment, the first electrode portion 221 has two opposite punched first side-end-faces 2210 that are flush with the peripheral end 213 of the PTC body 21. The first terminal lead portion 222 has two opposite punched first transverse-end-faces 2220, each of which is transverse to and intersects a respective one of the first side-end-faces 2210 so as to define a first corner 2215 therebetween. The second electrode portion 231 has two opposite punched second side-end-faces 2310 that are flush with the peripheral end 213 of the PTC body 21. The second terminal lead portion 232 has two opposite punched second transverse-end-faces 2320, each of which is transverse to and intersects a respective one of the second side-end-faces 2310 so as to define a second corner 2315 therebetween. The first and second side-end-faces 2210, 2310 and the first and second transverse-end-faces 2220, 2320 have structural characteristics indicative of them being formed by punching techniques.

FIGS. 6 to 12 illustrate steps of a method of making the embodiment of the PTC circuit protection chip device 7 according to the present disclosure. The method includes: preparing a PTC composition that contains a conductive filler and a polymer mixture; placing a spacer unit 32 on a first electrode sheet 33 of a metal-plated copper foil 72 (see FIG. 6), the spacer unit 32 including at least two stainless steel bars 321 which are spaced apart from each other and which cooperatively define an accommodating space 320 therebetween; compounding and extruding the PTC composition to form pellets 40 of a PTC polymer material 71 and filling the pellets 40 of the PTC polymer material 71 into the accommodating space 320, such that a body 4 of the pellets 40 of the PTC polymer material 71 slightly overfills the accommodating space 320 (see FIG. 7); placing a second electrode sheet 34 of the metal-plated copper foil 72 on a top side of the spacer unit 32 and a top side of the body 4 of the pellets 40 of the PTC polymer material 71, so that the body 4 of the pellets 40 of the PTC polymer material 71 and the spacer unit 32 are sandwiched between and cooperate with the first and second electrode sheets 33, 34 to form a stack 5 (see FIG. 8); subjecting the stack 5 to a hot pressing process so that the first and second electrode sheets 33, 34 contact and are pressed against the body 4 of the pellets 40 of the PTC polymer material 71 and the spacer unit 32, thereby forming the body 4 of the pellets 40 and the first and second electrode sheets 33, 34 into a PTC laminate 6 which includes an integrally-formed PTC layer 4' of the PTC polymer material 71 which are formed from the body 4 of the pellets 40 of the PTC polymer material 71 and which are bonded to and are sandwiched between the first and second electrode sheets 33, 34 (see FIG. 9); removing the spacer unit 32 from the PTC laminate 6 after the hot pressing (see FIGS. 10 and 11); subjecting the PTC polymer material 71 of the PTC layer 4' to cross-linking by irradiating it with Co-60 gamma ray after the hot pressing; and cutting the PTC laminate 6 after the removal of the spacer unit 32 so as to form the PTC circuit protection chip device 7 (see FIGS. 5, 11 and 12). It is noted that the pellets 40 of the PTC polymer material 71 undergo melting and then solidifying into the integrally-formed PTC layer 4' of the PTC polymer material 71 in the hot pressing process. It is further noted that only one PTC circuit protection chip device 7 is formed in the method as shown in FIGS. 6 to 12, however, the PTC laminate 6 may have a large size so that it may be cut into a plurality of the PTC circuit protection chip devices 7.

In this embodiment, the cutting of the PTC laminate 6 includes punching the PTC laminate 6 using a puncher (not shown). In certain embodiments, the cutting of the PTC laminate 6 may be conducted by punching the PTC laminate 6, followed by cutting unwanted portions of the punched PTC laminate 6 using a cutter (not shown).

In this embodiment, the metal-plated copper foil 72 is nickel-plated copper foil.

In certain embodiments, each of the first and second electrode sheets 33, 34 or each of the first and second single pieces 22, 23 may have a centerline average surface roughness ($R_a$) ranging from 0.9 μm to 2.0 μm, while in certain embodiments, each of the first and second electrode sheets 33, 34 or each of the first and second single pieces 22, 23 may have a centerline average surface roughness ($R_a$) ranging from 1.1 μm to 1.6 μm.

The polymer mixture may contains polyolefin (such as high density polyethylene, HDPE) and optionally a grafted polyolefin (such as grafted HDPE), such as carboxylic acid anhydride grafted polyolefin.

The conductive filler is dispersed in the PTC polymer material 71, and may include conductive non-carbonaceous particles and/or conductive carbon particles (such as carbon black).

Examples of the conductive non-carbonaceous particles may include titanium carbide, zirconium carbide, vanadium carbide, niobium carbide, tantalum carbide, chromium carbide, molybdenum carbide, tungsten carbide, titanium nitride, zirconium nitride, vanadium nitride, niobium nitride, tantalum nitride, chromium nitride, titanium disilicide, zirconium disilicide, niobium disilicide, tungsten disilicide, gold, silver, copper, aluminum, nickel, nickel-metallized glass beads, nickel-metallized graphite, Ti—Ta solid solution, W—Ti—Ta—Cr solid solution, W—Ta solid solution, W—Ti—Ta—Nb solid solution, W—Ti—Ta solid solution, W—Ti solid solution, Ta—Nb solid solution, and combinations thereof.

In certain embodiments, the polymer mixture may be in an amount ranging from 10 wt % to 30 wt % based on the weight of the PTC composition, and the conductive filler may be in an amount ranging from 70 wt % to 90 wt % based on the weight of the PTC composition.

The following examples and comparative examples are provided to illustrate the embodiment of the disclosure, and should not be construed as limiting the scope of the disclosure.

EXAMPLE

Example 1 (E1)

6.75 grams of HDPE (purchased from Formosa plastic Corp., catalog no.: HDPE9002, having a weight average molecular weight of 150,000 g/mole and a melt flow rate of 45 g/10 min according to AST D-1238 under a temperature of 230° C. and a load of 12.6 Kg), 6.75 grams of carboxylic acid anhydride grafted HDPE (purchased from DuPont, catalog no.: MB100D, having a weight average molecular weight of 80,000 g/mole and a melt flow rate of 75 g/10 min according to AST D-1238 under a temperature of 230° C. and a load of 12.6 Kg), and 136.5 grams of titanium carbide powder (having a particle size D50 ranging from 3.8 μm to 4.585 μm) were compounded in a Brabender mixer. The compounding temperature was 200° C., the stirring rate was 50 rpm, the applied pressure was 5 Kg, and the compounding time was 10 minutes. The compounded mixture was extruded to form pellets of a PTC polymer material. A spacer unit including two parallel stainless steel bars was placed on a first nickel-plated copper foil sheet having a thickness of 105 μm and a centerline average surface roughness (Ra) of 1.10 μm. The pellets were placed on the first nickel-plated copper foil sheet within an accommodating space between the stainless steel bars, such that the pellets slightly overfilled the accommodating space, so that the height of the body of the pellets is higher than that of the spacer unit. A second nickel-plated copper foil sheet (having a thickness of 105 μm and a centerline average surface roughness ($R_a$) of 1.10 μm) was placed on a top side of the body of the pellets and a top side of the spacer unit so as to cooperate with the body of the pellets, the spacer unit and the first nickel-plated copper foil sheet to form a stack. The stack was hot pressed so as to form a PTC laminate including a PTC polymer material (having a thickness substantially the same as the height of the spacer unit) sandwiched between the first and second nickel-plated copper foil sheets. The hot pressing temperature was 200° C., the hot pressing time was 4 minutes, and the hot pressing pressure was 80 kg/cm$^2$. The spacer unit was removed from the PTC laminate. The PTC laminate was irradiated with Co-60 gamma ray (a total dose of 5 Mrad) for cross-linking of the PTC polymer material, and was subsequently punched using a puncher so as to form a PTC circuit protection chip device. The resistance (R) of the PTC circuit protection chip device was measured to be 0.00133 ohm.

Examples 2 to 4 (E2-E4)

The procedures and conditions in preparing the PTC circuit protection chip devices of Examples 2 to 4 were similar to those of Example 1, except for the centerline average surface roughness ($R_a$) of the first and second nickel-plated copper foil sheets. The centerline average surface roughness ($R_a$) of the first nickel-plated copper foil sheets (same for the second nickel-plated copper foil sheets) of Examples 2 to 4 are respectively 1.59 μm, 0.96 μm, and 1.9 μm.

The resistances of the PTC circuit protection chip devices of Examples 2 to 4 were measured to be 0.00132 ohm, 0.00155 ohm, and 0.00149 ohm, respectively.

Comparative Example

Comparative Example 1 (CE1)

6.75 grams of HDPE (purchased from Formosa plastic Corp., catalog no.: HDPE9002, having a weight average molecular weight of 150,000 g/mole and a melt flow rate of 45 g/10 min according to AST D-1238 under a temperature of 230° C. and a load of 12.6 Kg), 6.75 grams of carboxylic acid anhydride grafted HDPE (purchased from DuPont, catalog no.: MB100D, having a weight average molecular weight of 80,000 g/mole and a melt flow rate of 75 g/10 min according to AST D-1238 under a temperature of 230° C. and a load of 12.6 Kg), and 136.5 grams of titanium carbide powder (having a particle size D50 ranging from 3.8 μm to 4.585 μm) were compounded in a Brabender mixer. The compounding temperature was 200° C., the stirring rate was 50 rpm, the applied pressure was 5 Kg, and the compounding time was 10 minutes. The compounded mixture was extruded to form pellets of a PTC polymer material. The pellets of the PTC polymer material was hot pressed under a temperature of 200° C. in a mold to form a thin sheet. The thin sheet and first and second nickel-plated copper foil sheets (which were respectively disposed on two opposite sides of the thin sheet and which had a centerline average surface roughness ($R_a$) of 1.10 μm) were hot pressed to form a PTC laminate. The hot pressing temperature was 200° C., the hot pressing time was 4 minutes, and the hot pressing pressure was 80 kg/cm. The PTC laminate was irradiated with Co-60 gamma ray (a total dose of 5 Mrad) for cross-linking of the PTC polymer material, and was cut into chip-scaled pieces. Each of the chip-scaled pieces was welded to first and second terminal leads (nickel plates) through a lead-free tin solder paste to form a PTC circuit protection chip device. The welding temperature was 260° C., and the welding time was 3 minutes. The resistances of the chip-scaled piece and the PTC circuit protection chip device of Comparative Example 1 were measured to be 0.00122 ohm and 0.00313 ohm, respectively.

Comparative Example 2 (CE2)

The procedures and conditions in preparing the PTC circuit protection chip device of Comparative Example 2 (CE2) were similar to those of Comparative Example 1, except for the centerline average surface roughness ($R_a$) of the first and second nickel-plated copper foil sheets. The centerline average surface roughness ($R_a$) of the first and second nickel-plated copper foil sheets of Comparative Example 2 was 1.59 μm.

The resistances of the chip-scaled piece and the PTC circuit protection chip device of Comparative Example 2 were measured to be 0.00123 ohm and 0.00312 ohm, respectively.

The Most Hold Current Test

The most hold current test is conducted by stepwisely increasing the current applied to a chip under a fixed DC voltage of 6V to find the maximum current under which the chip can endure for 15 minutes without breakdown.

Ten test samples of the PTC circuit protection chip device of each of E1 to E4 and CE1 to CE2 were subjected to the most hold current test to determine the most hold current of the PTC circuit protection chip device.

Table 1 shows the results of the most hold current test for E1 to E4 and CE1 to CE2, which demonstrate that the PTC circuit protection chip device of each of E1 to E4 has a higher most hold current than those of CE1 and CE2.

TABLE 1

| | | Switching cycle test | | |
|---|---|---|---|---|
| | Most hold current, A | $R_i$ ohm | $R_f$ ohm | $R_v$ % |
| E1 | 7.5 | 0.00134 | 0.02128 | 1488% |
| E2 | 7.6 | 0.00132 | 0.02229 | 1589% |
| E3 | 6.9 | 0.00155 | 0.02769 | 1686% |
| E4 | 7.0 | 0.00148 | 0.02613 | 1666% |
| CE1 | 4.9 | 0.00311 | 0.07290 | 2244% |
| CE2 | 5.0 | 0.00312 | 0.07102 | 2176% |

Switching Cycle Test

The switching cycle test is conducted by switching a chip on for 60 seconds and then off for 60 seconds per cycle under a voltage of 6Vdc and a current of 10 A for 7200 cycles. The initial resistance ($R_i$) (before the cycle test) and the final resistance ($R_f$) (after 7200 cycles) of the chip are measured to determine the resistance variation ($R_v$) of the chip after 7200 cycles, in which $R_v=100\%\times(R_f-R_i)/R_i$.

Ten test samples of the PTC circuit protection chip device of each of E1 to E4 and CE1 to CE2 were subjected to the switching cycle test to determine the resistance variation ($R_v$) of the PTC circuit protection chip device.

Table 1 also shows the results of the switching cycle test for E1 to E4 and CE1 to CE2, which demonstrate that the PTC circuit protection chip device of each of E1 to E4 has a lower resistance variation than those of CE1 and CE2.

In conclusion, with the use of the spacer unit 32 to form the PTC laminate 6 in the method of making the PTC circuit protection chip device 7 of the disclosure, the aforesaid drawback associated with the prior art can be eliminated.

While the present disclosure has been described in connection with what is considered the exemplary embodiment, it is understood that this disclosure is not limited to the disclosed embodiment but is intended to cover various arrangements included within the spirit and scope of the broadest interpretation and equivalent arrangements.

What is claimed is:

1. A method of making a PTC circuit protection chip device, comprising:

preparing an assembly of a PTC polymer material, a spacer unit, and first and second electrode sheets of a metal-plated copper foil, the PTC polymer material and the spacer unit of the assembly being sandwiched between and cooperating with the first and second electrode sheets to form a stack;

subjecting the stack to a hot pressing process, so that the first and second electrode sheets contact and are pressed against the PTC polymer material and the spacer unit and so that the PTC polymer material is bonded to and cooperates with the first and second electrode sheets to form a PTC laminate; and cutting the PTC laminate so as to form the PTC circuit protection chip device.

2. The method of claim 1, further comprising removing the spacer unit from the PTC laminate after the hot pressing.

3. The method of claim 1, wherein the cutting of the PTC laminate includes punching the PTC laminate into a structure that includes a first single piece of the metal-plated copper foil, a second single piece of the metal-plated copper foil, a PTC body of the PTC polymer material, the first single piece having a first electrode portion and a first terminal lead portion, the second single piece having a second electrode portion and a second terminal lead portion, the PTC body being sandwiched between the first and second electrode portions, the first and second terminal lead portions extending respectively from the first and second electrode portions beyond a peripheral end of the PTC body.

4. The method of claim 1, wherein the PTC polymer material is made from a PTC composition that contains polyolefin and a conductive filler.

5. The method of claim 4, wherein the PTC composition further contains a carboxylic acid anhydride grafted polyolefin.

6. The method of claim 4, further comprising subjecting the PTC polymer material to cross-linking after the hot pressing of the PTC laminate.

7. The method of claim 4, wherein the conductive filler contains titanium carbide particles.

8. The method of claim 1, wherein the metal-plated copper foil is nickel-plated copper foil.

9. The method of claim 1, wherein each of the first and second electrode sheets has a centerline average surface roughness ranging from 0.9 μm to 2.0 μm.

10. The method of claim 9, wherein each of the first and second electrode sheets has a centerline average surface roughness ranging from 1.1 μm to 1.6 μm.

11. A PTC circuit protection chip device comprising:

a PTC body of a PTC polymer material having opposite first and second surfaces and a peripheral end that is disposed between and interconnects said first and second surfaces;

a first single piece of a metal-plated copper foil that has a first electrode portion which is hot-pressedly bonded to said first surface of said PTC body, and a first terminal lead portion that extends from said first electrode portion beyond said peripheral end of said PTC body; and a second single piece of a metal-plated copper foil that has a second electrode portion which is hot-pressedly bonded to said second surface of said PTC body, and a second terminal lead portion that extends from said second electrode portion beyond said peripheral end of said PTC body;

wherein said first electrode portion has two opposite punched first side-end-faces that are flush with said peripheral end of said PTC body;

wherein said first terminal lead portion has two opposite punched first transverse-end-faces, each of which is transverse to and intersects a respective one of said first side-end-faces so as to define a first corner therebetween;

wherein said second electrode portion has two opposite punched second side-end-faces that are flush with said peripheral end of said PTC body; and wherein said second terminal lead portion has two opposite punched second transverse-end-faces, each of which is transverse to and intersects a respective one of said second side-end-faces so as to define a second corner therebetween.

12. The PTC circuit protection chip device of claim 11, wherein each of said first and second single pieces has a centerline average surface roughness ranging from 1.1 μm to 1.6 μm.

13. The PTC circuit protection chip device of claim 11, wherein the PTC polymer material is made from a PTC composition that contains polyolefin and a conductive filler.

14. The PTC circuit protection chip device of claim 13, wherein the PTC composition further contains a carboxylic acid anhydride grafted polyolefin.

15. The PTC circuit protection chip device of claim 13, wherein the conductive filler contains titanium carbide particles.

* * * * *